United States Patent [19]

Postler et al.

[11] Patent Number: 4,848,235

[45] Date of Patent: Jul. 18, 1989

[54] SUBMUNITION MEMBER WITH LATERALLY OUTWARDLY-MOVABLE TARGET DETECTION DEVICE

[75] Inventors: Gunter Postler, Rothenbach; Lothar Anacker, Nuremberg; Wilhelm Furst, Buchberg; Anton Brunner, Pappenheim, all of Fed. Rep. of Germany

[73] Assignee: Diehl GmbH & Co., Nuremberg, Fed. Rep. of Germany

[21] Appl. No.: 227,530

[22] Filed: Aug. 2, 1988

Related U.S. Application Data

[63] Continuation-in-part of Ser. No. 95,353, Sep. 10, 1987, abandoned.

[30] Foreign Application Priority Data

Sep. 12, 1986 [DE] Fed. Rep. of Germany ..... 3631078

[51] Int. Cl.[4] ..... F42B 13/50; F42B 25/16; F42C 9/04

[52] U.S. Cl. ..... 102/393; 102/235; 102/256; 102/489

[58] Field of Search ..... 102/393, 489, 213, 231, 102/235, 237, 241, 256

[56] References Cited

U.S. PATENT DOCUMENTS

| | | | |
|---|---|---|---|
| 3,786,759 | 1/1974 | Mellen et al. | 102/235 |
| 3,818,833 | 6/1974 | Throner | 102/393 |
| 3,834,312 | 9/1974 | Simmons | 102/339 |
| 3,981,239 | 9/1976 | Czajkowski et al. | 102/393 |
| 4,455,940 | 6/1984 | Furuike | 102/489 |
| 4,492,166 | 1/1985 | Purcell | 102/393 |
| 4,583,461 | 4/1986 | Weber | 102/489 |
| 4,587,902 | 5/1986 | Lindner et al. | 102/213 |
| 4,674,705 | 6/1987 | Schleicher | 244/3.1 |
| 4,679,503 | 7/1987 | Rüdenauer et al. | 102/208 |
| 4,753,171 | 6/1988 | Stessen | 102/387 |

*Primary Examiner*—David H. Brown

*Attorney, Agent, or Firm*—Scully, Scott, Murphy & Presser

[57] ABSTRACT

A rotating submunition member which, subsequent to ejection from a carrier, incorporates a target detection device projecting outwardly beyond the wall contour of the member in an operating position; and a fuze arrangement for a detonator which is disposed interiorly of the wall of the submunition. The submunition member is equipped with a securing or safe-and-arm device in which the detonator is located on a movable mounting or holder, which is displaceable through the intermediary of a spring-elastic power element from the SAFE position of the detonator into its ARMED position, when a flyweight has tensioned the power element and the target detection device is displaced into its operative position projecting beyond the wall contour of the submunition member.

13 Claims, 5 Drawing Sheets

SUBMUNITION MEMBER WITH LATERALLY OUTWARDLY-MOVABLE TARGET DETECTION DEVICE

CROSS-REFERENCE TO RELATED APPLICATIONS

This application is a continuation-in-part patent application of Ser. No. 95,353; filed Sept. 10, 1987.

BACKGROUND OF THE INVENTION

1. Field of the Invention

The present invention relates to a rotating submunition member which, subsequent to ejection from a carrier, incorporates a target detection device projecting outwardly beyond the wall contour of the member in an operating position; and a fuze arrangement for a detonator which is disposed interiorly of the wall of the submunition.

2. Discussion of the Prior Art

A submunition member of that type is known from the disclosure of U.S. Pat. No. 4,587,902, assigned to the common assignee of this application, the disclosure of which is incorporated herein by reference. The submunition distinguishes itself through the possession of a high proficiency in target acquisition during the direct attacking of armored targets under an indirect shot.

SUMMARY OF THE INVENTION

Accordingly, it is an object of the present invention to so modify and improve upon a submunition member of the type under consideration, such that, on the one hand, through a functional integration between the target detection device and, on the other hand, the fuze securing device, because of the constricted set up, there is an increase in available space for the installation of electronic detection and fuze circuits between the detector and the detonator, and as a result there is opened the possibility that, in the interest of obtaining an enhanced operational dependability, in accordance with contemplated conditions of utilization, there can be selected and realized at least two environmentally-dependent arming criteria from a larger available number of environmentally-dependent arming criteria.

In order to attain the foregoing object, it is possible, in any event, if necessary, to draw upon the technology relating to the arming of spin-stabilized projectiles, inasmuch as in the latter instances practically the entire cross-section is available for the build-up of a safe-and-arm or securing device employing the firing acceleration and, immediately thereafter, the stabilizing spin.

In contrast with the foregoing, the invention is predicated on the recognition that as a result of the considerable spatial requirements for the installation of the target detection device which is initially located within the contour of the submunition member, the outward displacement of the device into the operational position constructively as a safe-and-arm element and functionally as an environmentally-dependent arming criteria, in the interest of a compact constructive set-up or assembly of the safe-and-arm device, must for the remainder be able to be coupled with the function thereof.

In recognition of these conditions, the abovementioned object pursuant to the invention is inventively achieved in that the submunition member of the type under consideration is equipped with a securing or safe-and-arm device in which the detonator is located on a movable mounting or holder, which is displaceable through the intermediary of a spring-elastic power element from the SAFE position of the detonator into its ARMED position, when a fly weight has tensioned the power element and the target detection device is displaced into its operative position projecting beyond the wall contour of the submunition member.

In accordance with the foregoing, the governing arming criterium resides in the outward displacement into the operative position of the target detection device, which is initially arranged within the submunition contour, wherein the displacement takes place, pursuant to operational requirements, only after the deployment of the submunition member by means of a carrier and the release of the former over the target area. Inasmuch as the target detection device, which has not yet moved into the outward position, will mechanically prevent the detonator from being set into its ARMED position, a triggering of the explosive is only first possible when the target detection device is not only actually present (and thereby electrically connected with the fuze device), but has also been displaced outwardly into the operative position. However, even then the detonator can be displaced into its ARMED position, when additional environmental criteria have taken place or are evident; for instance, such as at least a definite longitudinal acceleration during the course of the deployment of the submunition over the target area, and/or at least a centrifugal force oriented radially relative to the system axis (for example, the defined reduction in the originally greater centrifugal force) during the course of the deployment above the target area or during the course of the descent into the target area; as well as, upon occasion, the removal of constructive constraints due to the freeing of the submunition member contour upon ejection from the carrier or upon the lifting away of despin flaps which were here initially still retracted against the periphery.

In addition to the constructive arresting or constraint of the detonator in its SAFE position for a target detection device which has not yet been displaced outwardly of the submunition contour, in the interest of meeting increased safety and operational demands, in this instance, there can be provided a further operative or functional linkage, in that the target detection device itself serves as a centrifugal fly weight for the tensioning of an actuating or power element for the movement of the detonator mounting into its ARMED position. The installation of this detonator mounting is itself preferably undertaken in such a manner, that the spin of the submunition member tends to provide for its displacement into the SAFE position, which can only first be overcome by the counteracting force subsequent to the spin-dependent tensioning of the actuating element. This possesses the concurrent advantage that, in this SAFE position, the detonator mounting allows for an almost frictionless pulling of latching pins (for example, through the use of an axially-parallel arranged double-recoiling bolt system, or through electrical or pyrotechnic power elements).

In all instances, the functional or operational linkage between the target detection device and the fuze safe-and-arm device provides the necessary open space for the installation of the detector circuits (for the actuation of the fuze device, when a target object is detected in front of its effective direction); whereby this open space, at a linear carriage guide for the detector mounting, can be located in the latter, in contrast at an axially-parallel pivoted guide for the detector mounting, structurally fixed between the latter and a housing for the guidance of movement for the detonator mounting.

BRIEF DESCRIPTION OF THE DRAWINGS

Additional alternatives and further modifications, as well as other features and advantages of the invention may now be readily ascertained from the following detailed description of exemplary embodiments thereof, taken in conjunction with the accompanying drawings; in which.

DETAILED DESCRIPTION

Figure 1:
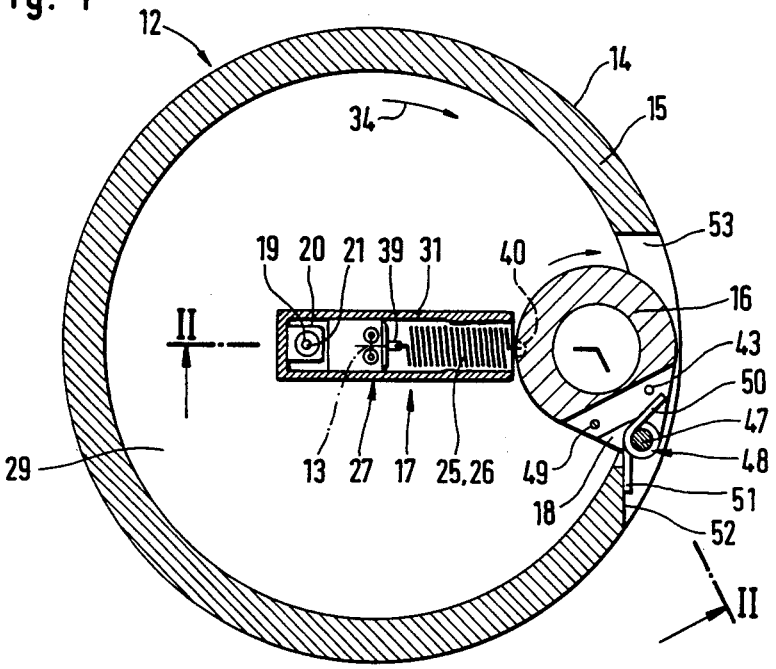
FIG. 1 illustrates a transverse cross-sectional view through a submunition member in a view facing towards the target detection device thereof, which has not yet been extended outwardly thereof; in effect, in the SAFE position of its fuze device.

In the illustrated submunition member 12 the latter pertains to a hollow-cylindrical structure which is divided into a plurality of axial sections, wherein the structure rotates about its longitudinal axis 13 during employment thereof, which axis is offset at a slight angle relative to the vertical, so as to during descent into a target area, scan the latter by means of a target detection device 16 displaced outwardly of the outer contour 14 of its wall 15, along somewhat spiral tracks searching for a target object at a constantly reducing radius. In the drawing, the target detection device 16 is not represented in the position in which it is outwardly displaced into its working location, in order to be able to more clearly emphasize its cooperation with a fuze securing or safe-and-arm arrangement 17. In this case, it is to be understood that the target detection device 16 is the entirety of a magnifying lens-like (FIG. 1 and FIG. 2) or carriage-like (FIG. 3) mounting or support 18 which is movable somewhat radially outwardly of a cylindrical wall 15, for supporting a receiver for electromagnetic energy. This receiver may be in the millimeter-wave range or in the infrared range of the radiation spectrum (for example, a radiometer antenna or infrared detector), inclusive of any auxiliary means (such as mirrors, lenses) for influencing the path of the radiation energy assumed by the receiver somewhat in parallel with the longitudinal and effective axis 13 of the submunition. Also included may be auxiliary and evaluating circuits cooperating inclusively with the receiver (for example, cooling circuits and preamplifiers) and, in certain instances, including in every case the first stages of the received signal processing for the triggering actuation of the fuze arrangement 19 in the case of a target object which is detected in front of the effective axis 13 and which is to be attacked.

Figure 4:
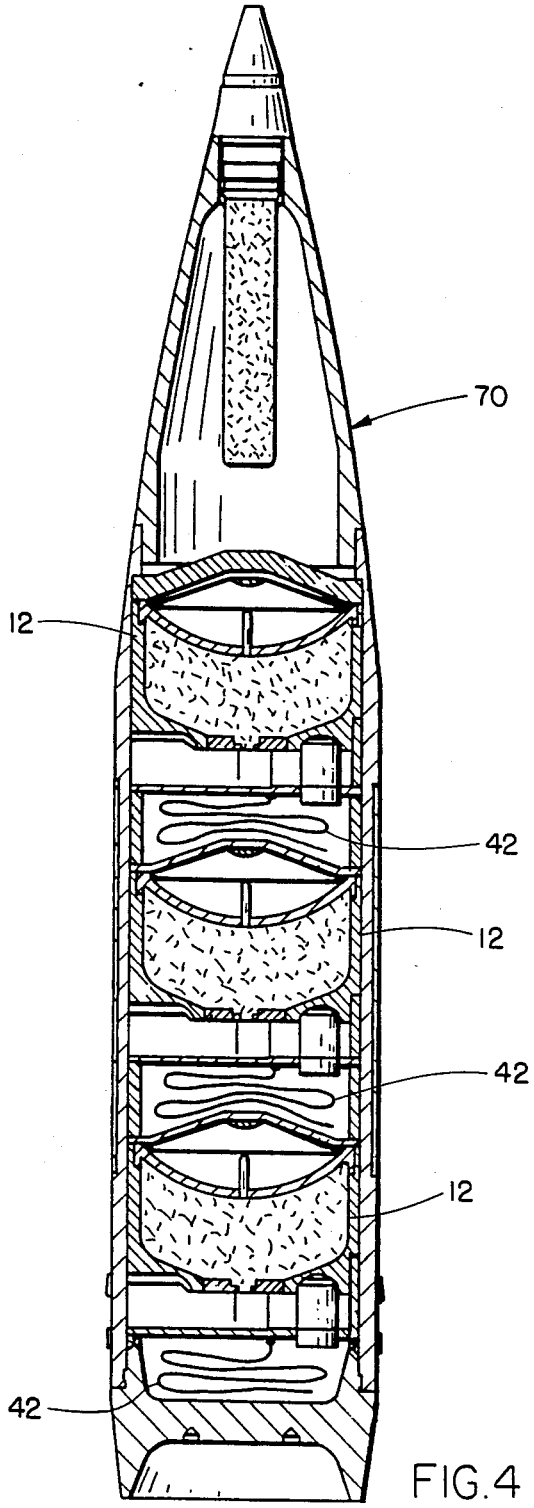
FIG. 4 illustrates, in a longitudinal sectional view, a typical carrier projectile housing a plurality of submunition members.
Figure 5:
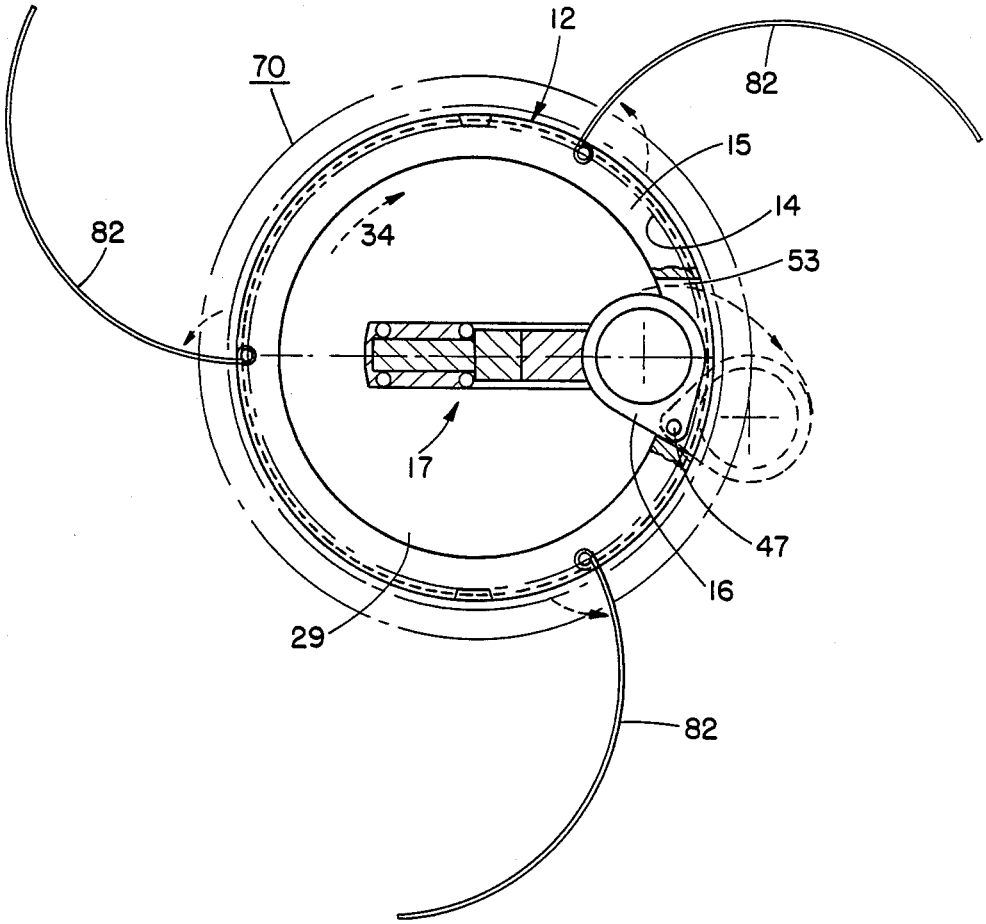
FIG. 5 schematically illustrates the release of despinning flaps upon release of the submunition from the carrier.

While the submunition member 12 is deployed over the target area through the intermediary of a carrier 70, as shown in FIG. 4, in which parachute systems, referring to copending U.S. Ser. No. 101,651; the mounting support in the carrier, or respectively, the peripheral contact of despinning fins 82 as shown in FIG. 5, which are to be subsequently extended, prevents any outward movement of the target detection device 16 beyond the wall contour 14. As a result of the direct or indirect contact of a detonator mounting or support 20 against a portion of the target detection device 16 which projects into the interior of the wall 15, this support 20 can in any case not be moved into the ARMED position of the detonator, as long as the target detection device 16, always as a reason of which, for example, due to the still present constraint within the carrier during the deployment of the submunition 12, was not yet outwardly displaced.

Concurrently, this provides assurance that the detonator mounting or support 20 will not be erroneously installed in its ARMED position during assembly; thereby the target detection device 16 must either be entirely left out (which presumes the possibility of a triggering of the fuze arrangement 19), or possibly, the target detection device 16 cannot be displaced into its inward position; in effect, the submunition 12 cannot at all be inserted into the carrier.

The above-mentioned ARMED position of the detonator support 20 is obtained when the detonator 21, which is inserted therein, stands behind a transmitting charge 22 (FIG. 2) coaxially in the rearward barrier or damming plate 23 for the explosive 24 of a projectile-forming warhead (not shown in the drawing). In this, and only in this, position through the electrical activation of the detonator 21 from the fuze arrangement 19, can there be detonated the explosive 24 for the attacking of a target object which is ascertained axially in front thereof by means of the target detection device 16.

When the support 25 for the detonator mounting 20 is pressed against the inner region of the not yet outwardly displaced target detection device 16, the detonator mounting 20 is subjected to a force by means of a spring-elastic actuator or drive element 26 for the movement of the detonator 21 into the ARMED position. However, this movement can only be effectuated upon removal of a blockage 27. The blockage can relate to pins 28 which, in the SAFE position of the fuze safe-and-arm arrangement 17 initially still engage into the cover 29 for the guidance of the detonator mounting 20. For example, this engagement can be implemented through electrical or pyrotechnic draw piston-power elements, as shown in U.S. Pat. No. 4,679,503, controlled from an electronic arming-sequence control circuit, when from the deployment for the utilization of the submunition 12, there are not available any other directly-functioning, environmentally-dependent arming criteria.

In the last instance, for example, in the case of the deployment of the submunition 12 by means of a grenade fired from a weapon barrel or launch tube, this relates, on the one hand, to the high firing acceleration at the launching of the grenade and, on the other hand, the always less intensive acceleration acting in an opposite direction but also in parallel with the axis 13, during the rearward ejection of the submunitions 12 from this carrier. Such influences of acceleration of relatively defined magnitude and duration can be evaluated in a known manner as arming criteria by means of so-called double firing bolts, which have the arresting pins 28 drawn in response to the inertia of sliding bolts. During firing or launching, in response to either electrical actuation or mechanical inertia effects, the forward arresting pin 28 (FIG. 2) is displaced into a rearward unlatched position. The pin is then latched in this position to prevent a subsequent unintended return to its initial position of latching by the provision of a suitable locking ball engaging into a recess in the pin when the latter has been displaced into its unlatching position. Subsequently, after a certain period of flight (or remotely-controlled) the submunition members 12 are discharged rearwardly from the carrier. This can be implemented by a gas generator or by the parachutes which are drawn out by the aerodynamic slipstream from the carrier tail end; as shown in U.S. Pat. No. 3,834,312. In order to avoid the need for an excessively high force for the drawing of the arresting pins 28, the mounting 20 in the SAFE position of the detonator 21 lies expediently in such a defined position, opposite the target detection device 16, against a housing 31 which is secured to the structure, that the arresting pins 28 engage under radial play into the associated arresting apertures 32 provided in the housing cover 29; in effect, can be drawn out of this position without any friction. This contact 33 can be implemented through the suitable dimensioning of the support 25 (eventually constructed for this purpose so as to be compressively-resilient over a pregiven distance). In lieu thereof, or in addition thereto, it can be advantageous for this defined contact 33, that as considered in the drawing the center of gravity of the operationally-ready equipped mounting 20 be arranged in its SAFE position (FIG. 2) somewhat offset from the axis of rotation of the submunition 12, such that the mounting 20, as a result of the centrifugal forces generated by the spin 34, will then also be pressed into the defined contact 33 of the SAFE position of the detonator 21, when the arresting pins 28 indicate a malfunctioning due to any kind of reason, or possibly may have been even completely forgotten during the installation.

When the arresting pins 28 are drawn subsequent to the ejection of the submunition 12 from the carrier, and the support 25 is moved, inasmuch as the target detection device 16 has been displaced into its working position outwardly of the cylinder wall 15 (in essence, through the engagement of a force engagement of a separately actuated power element acting radially with respect to the cylinder axis 13 or simply through the centrifugal force), then there is eliminated the support 25 of the detonator mounting 20 at the inside of the target detection device 16. Consequently, thereof, under the influence of a force component 35 through the spring-elastic actuating element 26, he detonator mounting 20 can now be moved out of its (illustrated in the drawing) SAFE position into the prescribed ARMED position in which then remains fixed through engagement of an elastically supported holding protrusion 36 in a holding aperture 37 provided in the housing 31 or, respectively, in its cover 29. The force components 35 for the movement of the detonator mounting 20 into its ARMED position can similarly, also be produced by a separately actuated power element. However, there is presented an additional safety aspect when the spin 34 of the operational submunition is evaluated for this purpose during descent thereof into the target area; in effect, when a centrifugal flyweight 38 engages through the spring-elastic actuating element 26 against the detonator mounting 20. In the exemplary embodiment pursuant to FIGS. 1 and 2, this centrifugal mass or flyweight 38 is identical with the detector mounting or support 18 which, subsequent to release from the carrier, will be displaced from the inner position outwardly of the wall contour 14 in response to the spin 34 of the submunition. The spring-elastic actuating element 26 hereby preferably relates to a cylindrical tension spring extending between a mounting suspension 39 and a detector suspension 40. This spring is expediently dimensioned such that in the secured or SAFE position of the detonator 20 it is compressed to its solid length between its suspensions 39 and 40; in effect, in the axial direction of the spring windings contact against the windings. Thus, through the intermediary of this actuating or drive element 26 there is concurrently realized the support 25 between the target detection device 16 which has not yet moved outwardly into the operating position and the detonator mounting 20 which stands in the SAFE position.

Figure 6:
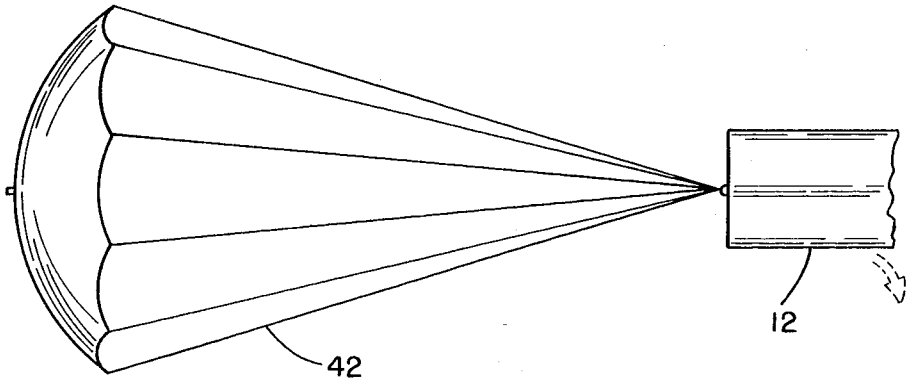
FIG. 6 illustrates the attachment of a parachute to the submunition members.

After the ejection from the carrier, there is extended a braking parachute, as shown in FIG. 6, and also described in U.S. Pat. No. 4,753,171, which is assigned to the common assignee of this application, and is incorporated herein by reference, and despinning flaps or fins which have heretofore been peripherally retracted against the outer contour 14; for example, such as are disclosed in FIG. 5, and in U.S. Pat. 4,674,705, assigned to the present assignee, and the disclosure of which is incorporated herein by reference, are radially extended, so as to expose a break-through or opening 51, for the outward pivoting of the detector mounting or support 18. In a type or class of submunition members 12 as considered herein, behind the fuze safe-and-arm arrangement 17 there is provided a packing container 41 for a further parachute system 42 which can be drawn out rearwardly from the wall 15, by means of which, during descent into the target area, there is ensured a definite frequency of rotation for the spin 34 at a reduced speed of descent. After a certain effective time period for the braking parachute, the latter is released so as to then draw out the packing container for the unfolding of such further parachute system 42. As a further arresting means for the detonator mounting 20 in its SAFE position, in effect, as a further arming criteria, as a result there can thus be utilized the pulling out of the packing container 41 at the beginning of the kinematically defined descent into the target area. This is symbolically considered in FIG. 2 through the provision of an arresting pin 43 at the bottom 44 on the packing container, which enter into a path of movement into the ARMED position for the fuze securing or safe-and-arm arrangement 17; thus, for example, into or in front of the still secured detonator mounting 20 or preferably, as illustrated, into the detector support 18 which has not yet moved outwardly into the operating position.

In order that, in the instance of the SAFE support 25 between the detector support 18 and the detonator mounting 20, a spiral spring which is compressed to solid length will not bend or deflect as an extended actuating element 26 (in essence, lose its effect as support 25), when transversely thereof (in the direction of a system axis 13) there are encountered the shock loads due to the firing acceleration of the carrier, the ejecting acceleration from the carrier, and/or the delay encountered during the unfolding of the first parachute, the support 25 is expediently provided with a guide 45 extending transversely of this load between support rods or within a conduit. Preferably, the guide 45 is formed on the housing 31 for the detonator mounting 20 so as to project collar-like in a direction towards the target detection device 16, as can be readily ascertained from the cross-sectional view in FIG. 2. The exemplary constructional embodiment illustrated in FIGS. 1 and 2 for the target detection arrangement 16 which cooperates with the fuze safe-and-arm device 17, is in particular adapted for submunition members 12 possessing a small caliber (diameter). In this case there is radially provided an open space 46 between the housing 31 for the detonator mounting 20 and the target detection device 16 which has not yet been displaced into its working position for the already above-mentioned auxiliary and evaluating circuits 30 for the actuation of the fuze arrangement 19 upon detection of a target object which is to be attacked. The detector support 18 is displaced about a pivot axis 47 into its operative position, which lies (somewhat) in parallel with the system axis 13 within the hollow cylindrical wall 15; in effect, extends over the entire axial constructional height of the detector support 18, and thereby guarantees a stable positioning of the target detection device 16 in a reproduceable location relative to the effective axis 13 of the explosive 24.

In FIG. 1 consideration is given to that it can be expedient that the movement of the detector support 18 which is magnifying lens-shaped in cross-section, and which is produced by the centrifugal force of the spin 34, will be braked in its operative position at an inertial-dependent exceeding of this operative position, through the engagement of a spiral spring 48 which, for support, is shown in the illustrated exemplary embodiment as being wound about the pivot axle 47. When the outwardly pivoted detector support 18 has a support pin 49 come into contact against the one arm 50 of the spring 48, then the oppositely located arm 51 supports itself against the adjacent wall 52 of the break-through or opening 53 extending through the hollow cylindrical wall 15, through which the detector support 18 is movable from the inwardly located stored or deploying position into the outwardly located obtaining position.

In the interest of obtaining a clarity in overview, it is not considered in the drawing that for the arresting of the target detection device 16 into its operative position projecting beyond the wall contour 14, there is also expediently provided a spring-loaded latching arrangement between the detonator support and the wall 15.

Figure 3:
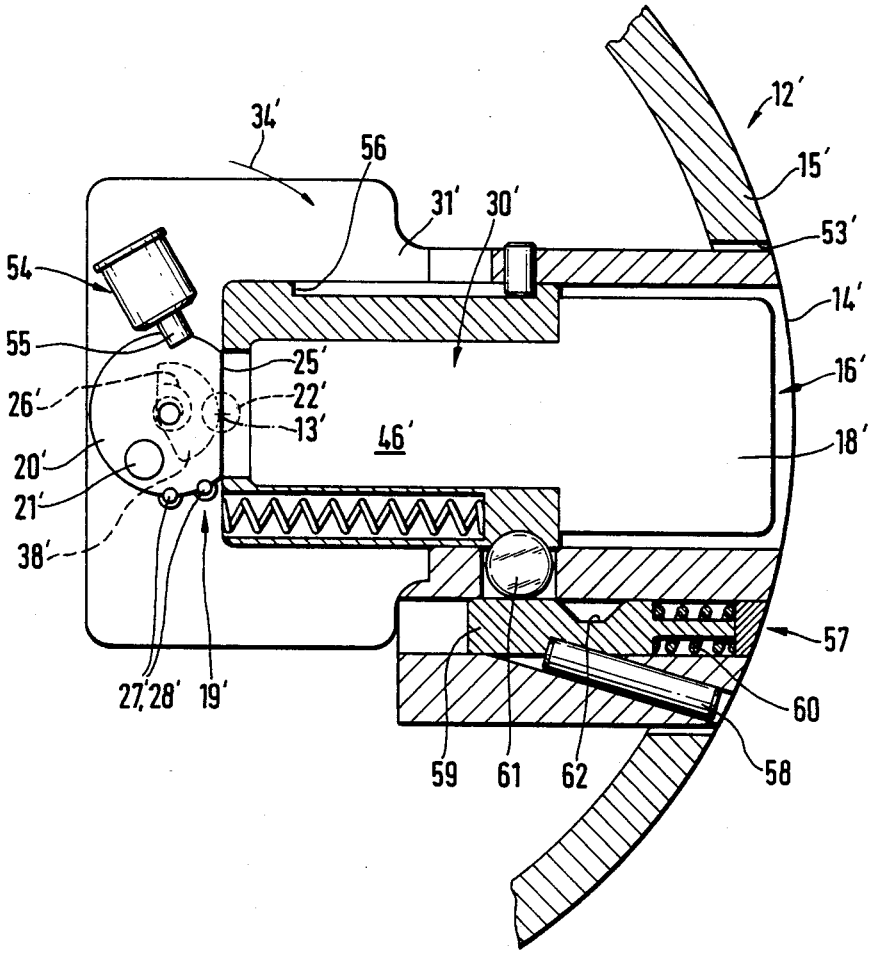
FIG. 3 illustrates an embodiment which is modified with respect to that of FIGS. 1 and 2, for the cooperation of a target detection device with a safe-and-arm device of a fuze device for submunition; illustrated in a fragmentary sectional view similar to FIG. 1, shown on an enlarged scale.

For larger-calibered submunition members 12', pursuant to FIG. 3, the available or open space 46' for installation can be at least partly shifted into the detector support 18', inasmuch as this can be moved radially (linearly carriage-like relative to the system axis 13' through the cylinder wall 15' into its working position externally of the wall contour 14', and is thereby imparted a sufficiently long sliding guidance for a reproduceable outwardly extended position.

In turn, the detonator mounting 20' is so dimensioned or installed on the one hand with respect to its center of gravity that the centrifugal force acting on the detonator mounting 20' tends to produce a movement into the SAFE position for the detonator 21'. However, this embodiment, in contrast with FIGS. 1 and 2, does not relate to a linearly displaceable detonator mounting 20, but to a rotating mounting or support 20'. Also the latter is blocked in the SAFE position of the detonator 21' at a target detection device 16 which has not yet moved outwardly into the operative position, because of the pressure of rearward support 25'; in which this support 25' is directly arranged intermediate the mountings 18' and 20'. At either a lack of, or a longer present support 25', the detonator mounting 20' can first again move the detonator 21' only into its ARMED position, when in dependence upon encountered acceleration forces and/or of electrical control signals, there is removed a blockage 27' for the mounting 20' relative to the housing 31' through withdrawal of blocking pins 28'.

For the thereafter possible movement of the detonator mounting 20' into its ARMED position, there is again provided a spring-elastic actuating or drive element 26', on which there acts a kinematic power component. In the illustrated embodiment this is implemented through a fly weight or centrifugal mass 38' in the configuration of an eccentric rotatably supported coaxially with the detonator mounting 20', which tensions the actuating element 26 (in the form of a torsion spring between the centrifugal weight 38' and the detonator mounting 20'), when the eccentric is displaced into its stressing position due to the spin 34 of the submunition 12' and arrested therein (not shown in the drawing). The actuating element 26', which is stressed by the eccentric, can thereafter displace the detonator 21' into its ARMED position through the triggering aperture 22', when an additionally provided centrifugal safety 54 has released this sequence of movement for the detonator mounting 20. With respect to the safety 54, this can pertain to a spring-loaded securing pin 55 which engages into the detonator mounting 20' in a radial direction relative to the system axis 13', which will only displace from this secured engagement (and be arrested in the solid-line drawn position), when there is encountered a sufficiently intense spin 34' (for instance, during the course of the firing of a spin-stabilized carrier for the submunition member 12').

Figure 2:
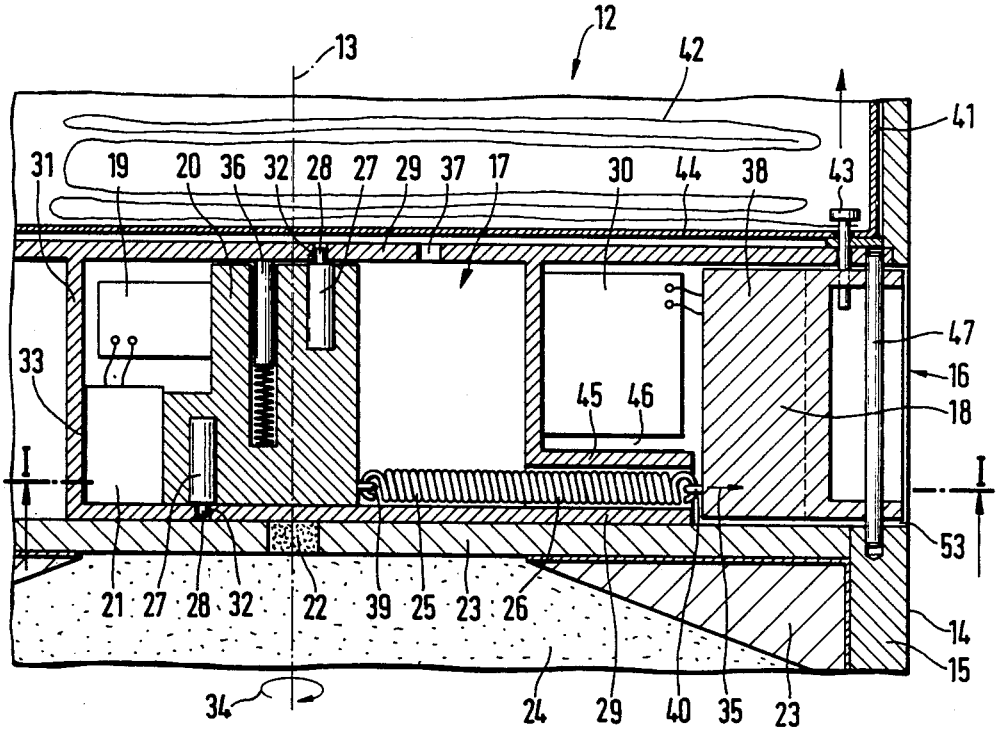
FIG. 2 illustrates a fragmentary segment of the submunition member of FIG. 1 shown in a bent longitudinal cross-section in the direction of the section line II in FIG. 1.

When the target detection device 16' is outwardly displaced immediately after the release of the submunition member 12' from a rapidly rotating carrier due to the centrifugal forces acting on the detector support 18'; in essence, in contrast with the conditions pursuant to FIG. 2 there is not contemplated any delayed release, for instance, in dependence upon the pulling of the parachute packing container (not shown in FIG. 3), it cannot be precluded that no reproduceable end position is assumed for the detector drive, inasmuch as the detector support 18' travels with an excessively large force against the constructively pregiven contact 56. Moreover, a target detection device 16' which moves prematurely outwardly of the wall contour can be damaged by the braking flaps which, initially, are yet to be outwardly extended into their stationary end position, which in a submunition member 12' of the type under consideration herein, are frequently articulated to the wall 15' in parallel with the system axis 13' in order to lead to a more rapid reduction in the spin 34' during descent above the target area (not shown in the drawing). Consequently, it can be expedient, pursuant to FIG. 3, to provide a delay device 57 for the outward displacement which frees the movement of the target detection device 16' (and dependently therefrom the movement of the detonator mounting 20' into its ARMED position) only when the initially high spin 34' of the submunition member 12', when released from the carrier, has already been sufficiently reduced due to the radially outwardly extended despinning flaps or fins. In the illustrated exemplary embodiment (FIG. 3) such a delay device 57 is in particular provided with a latch 59 which is initially arrested by a retainer pin 58 which is somewhat radial relative to the system axis 13'. This pin is displaced from its arresting position in response to the centrifugal forces, when it is no longer restrained against the wall contour 14' (inasmuch as the submunition 12' has already exited from the carrier and since eventually the initially peripherally retracted despinning flaps 82 have been radially extended). The latch 59 which has been released by the retainer pin 58, and which latch is also displaceable somewhat radially relative to the system axis 13', can first be displaced by a spring 60 acting against the centrifugal force, from the blocking position shown in FIG. 3 into a releasing position, when the centrifugal force acting on the latch 59 is lessened because of the reduced spin 34'; in effect, less than the counteracting force of the spring 60. A roll member 61 which partly engages into the detector support 18' (in the interest of obtaining a limited specific surface pressure being preferably constructed as a roller) will then fall into a recess 62 provided on the latch 59, and the target detection device 16' is released; in essence, due to the centrifugal force exerted as a consequence of the residual spin 34', will displace itself with a correspondingly lower kinetic energy into a reproducably arrestable operative position outside of the wall contour 14'.

Hereby, after a sufficient reduction of the initial spin 34' and thereby some time interval after the start of the descent over the target area, the detonator mounting 20' can be conveyed by the tensioned spring-elastic actuating or drive element 26' into the ARMED position, inasmuch as because of the displaced detector support 18', there has been eliminated the heretofore arresting support 25'.

The fuze arrangement 19' is now ARMED, and the detonator 21', upon the detection of a target object forwardly along the effective axis 13', is actuated for the detonation of the warhead.

What is claimed is:

1. In a rotating submunition member including target detection means projecting radially outwardly of the wall contour of said submunition member in an operative position after ejection of said submunition member from a carrier; and a fuze arrangement for a detonator supported on movable mounting means located within said submunition member; the improvement comprising said movable mounting means having said detonator arranged thereon; a spring-elastic actuating element for displacing said mounting means from a SAFE position of the detonator into an ARMED position responsive to a centrifugal weight tensioning said actuating element and upon said target detection means having been displaced into the operative position thereof projecting outwardly of the wall contour of said submunition member.

2. A submunition member as claimed in claim 1, comprising means for the release of the displacement of the target detection means into the operating position projecting outwardly of the wall contour responsive to the release of said submunition member from said carrier or the outward extension of despinning flaps which are initially peripherally retracted against the wall contour of said submunition member.

3. A submunition member as claimed in claim 1, comprising arresting pin means for arresting the target detection means and the detonator mounting; said arresting pin means being withdrawable in dependence upon the unfolding of a parachute system.

4. A submunition member as claimed in claim 1, wherein the target detection means constitutes the centrifugal weight for the tensioning of the actuating element for the detonator mounting means.

5. A submunition member as claimed in claim 1, wherein the detonator mounting means and the target detection means respectively engage arresting pins in the SAFE position, said arresting pins being releasable in dependence upon the generation of defined acceleration forces in parallel with the spin axis or in dependence upon actuation from an arming circuit.

6. A submunition member as claimed in claim 1, wherein the target detection means and the detonator mounting means are arrested in the respective SAFE positions thereof through pins which release in dependence upon the spin or exit of said submunition member from a carrier or the extension of despinning flaps which are initially peripherally retracted against the wall contour of said submunition member.

7. A submunition member as claimed in claim 1, wherein said movable mounting means is configured such that the center of gravity thereof is offset relative to the spin axis of said submunition member so as to cause said movable mounting means to be pressed into the SAFE position responsive to a centrifugal force.

8. A submunition member as claimed in claim 1, including a spring supported at one end against the target detection means and at the other end against the wall of said submunition member for braking the target detection means during movement from the SAFE position into the operative position thereof.

9. A submunition member as claimed in claim 1, comprising delay means for delaying the outward displacement of the target detection device during transition from the SAFE position into the operative position to after the reaching of an adequate reduction in the initial spin of said submunition member.

10. A submunition member as claimed in Clam 1, comprising a pivot axle arranged in the wall of said submunition member and being oriented substantially in parallel with the system axis for the outward extension of the target detection means from the SAFE position into the operative position.

11. A submunition member as claimed in claim 1, wherein said target detection means is displaceable substantially radially relative to the system axis, and includes an integrated open space for the installation of detector circuits.

12. A submunition member as claimed in claim 1, comprising support means between said.movable mounting means and the target detection means in the respective SAFE positions thereof, said support means including a cylindrical tension spring compressed into solid length to form said actuating element for said movable mounting means.

13. A submunition member as claimed in claim 12, comprising guide means for the actuating element oriented transversely of the spin axis of said submunition member.

* * * * *